US012723373B2

(12) United States Patent
Muraoka et al.

(10) Patent No.: US 12,723,373 B2
(45) Date of Patent: Sep. 1, 2026

(54) HYDRAULIC DRIVE DEVICE

(71) Applicant: KAWASAKI JUKOGYO KABUSHIKI KAISHA, Kobe (JP)

(72) Inventors: Hideyasu Muraoka, Kobe (JP); Nobuyuki Kinoshita, Kobe (JP); Yoji Yudate, Kobe (JP); Yoshihiko Hata, Kobe (JP); Yuki Kuwabara, Kobe (JP); Yuichi Miyagi, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 18/877,631

(22) PCT Filed: Apr. 4, 2023

(86) PCT No.: PCT/JP2023/013916
§ 371 (c)(1),
(2) Date: Dec. 20, 2024

(87) PCT Pub. No.: WO2023/248578
PCT Pub. Date: Dec. 28, 2023

(65) Prior Publication Data

US 2025/0389104 A1 Dec. 25, 2025

(30) Foreign Application Priority Data

Jun. 23, 2022 (JP) ..... 2022-101448

(51) Int. Cl.
*E02F 9/22* (2006.01)

(52) U.S. Cl.
CPC ..... *E02F 9/2292* (2013.01); *E02F 9/2267* (2013.01); *E02F 9/2296* (2013.01)

(58) Field of Classification Search
CPC ..... F15B 2211/7142; E02F 9/2292; E02F 9/2289
See application file for complete search history.

(56) References Cited

U.S. PATENT DOCUMENTS 8,943,819 B2 * 2/2015 Knussman ..... F15B 11/17 60/486
9,068,578 B2 * 6/2015 Opdenbosch ..... F15B 13/06
(Continued)

FOREIGN PATENT DOCUMENTS

JP 2004028212 A 1/2004
JP 2004190845 A 7/2004
(Continued)

*Primary Examiner* — Abiy Teka
(74) *Attorney, Agent, or Firm* — Alleman Hall LLP

(57) ABSTRACT

This hydraulic drive device supplies a working fluid to a plurality of hydraulic cylinders including a first hydraulic cylinder and includes: a plurality of hydraulic drive systems that are respectively associated with the plurality of hydraulic cylinders and each of which supplies the working fluid to the corresponding hydraulic cylinder; and one or more communication valves that place the plurality of hydraulic drive systems in communication with each other according to a received communication command. Each of the plurality of hydraulic drive systems includes a hydraulic pump motor, an electric motor, and a directional control valve. A first hydraulic drive system which is associated with the first hydraulic cylinder includes a first directional control valve that is the directional control valve. The first directional control valve causes the working fluid to flow from the first hydraulic cylinder to the hydraulic pump motor according to a received first operation command.

9 Claims, 2 Drawing Sheets

(56) References Cited

U.S. PATENT DOCUMENTS

| | | | | |
|---|---|---|---|---|
| 9,845,813 | B2 | 12/2017 | Shimizu et al. | |
| 10,415,215 | B2 * | 9/2019 | Takahashi | E02F 9/2235 |
| 2005/0246082 | A1 | 11/2005 | Miki et al. | |
| 2022/0259828 | A1 * | 8/2022 | Zhang | E02F 9/2242 |

FOREIGN PATENT DOCUMENTS

| | | | |
|---|---|---|---|
| JP | 2016223613 | A | 12/2016 |
| WO | 2021066892 | A1 | 4/2021 |

* cited by examiner

HYDRAULIC DRIVE DEVICE

TECHNICAL FIELD

The present invention relates to a hydraulic drive device that supplies a working fluid to a hydraulic cylinder.

BACKGROUND ART

A hydraulic drive device drives a hydraulic cylinder by supplying a working fluid to the hydraulic cylinder. For example, a drive device such as that disclosed in Patent Literature (PTL) 1 is known as the hydraulic drive device. The drive device disclosed in PTL 1 includes a plurality of drive circuits. One of the plurality of drive circuits includes a pump motor that generates power using a return fluid from the hydraulic cylinder. Meanwhile, the other drive circuits are operated using the power generated by the pump motor. More specifically, the other drive circuits include electric pumps. Using the power generated, the other drive circuits operate the electric pumps.

CITATION LIST

Patent Literature

PTL 1: Japanese Laid-Open Patent Application Publication No. 2004-190845

SUMMARY OF INVENTION

Technical Problem

The drive device disclosed in PTL 1 uses a pump motor of a capacity corresponding to the flow rate of a fluid returning from a fluid pressure actuator, namely, a return flow rate. Therefore, it is necessary to use a pump motor of a capacity corresponding to the size of the hydraulic cylinder. This makes it difficult to reduce the size of the pump motor.

Thus, an object of the present invention is to provide a hydraulic drive device including a hydraulic pump motor reduced in size.

Solution to Problem

A hydraulic drive device according to the present invention supplies a working fluid to a plurality of hydraulic cylinders including a first hydraulic cylinder and includes: a plurality of hydraulic drive systems that are respectively associated with the plurality of hydraulic cylinders and each of which supplies the working fluid to a corresponding one of the plurality of hydraulic cylinders; and one or more communication valves that place the plurality of hydraulic drive systems in communication with each other according to a communication command that is input to the one or more communication valves. Each of the plurality of hydraulic drive systems includes: a hydraulic pump motor that discharges the working fluid and when supplied with the working fluid, rotates; an electric motor that rotatably drives the hydraulic pump motor to cause the working fluid to be discharged from the hydraulic pump motor, and generates power by being rotatably driven by the hydraulic pump motor; and a directional control valve that switches, according to an operation command, a flow direction of the working fluid flowing between the hydraulic pump motor and a corresponding one of the plurality of hydraulic cylinders. A first hydraulic drive system that is one of the plurality of hydraulic drive systems that is associated with the first hydraulic cylinder includes a first directional control valve that is the directional control valve. The first directional control valve causes the working fluid to flow from the first hydraulic cylinder to the hydraulic pump motor according to a first operation command that is input to the first directional control valve.

According to the present invention, one or more communication valves are provided that place the plurality of hydraulic drive systems in communication with each other according to the communication command that is input to the communication valves. Therefore, when the communication command is output to the communication valve at the time that the first directional control valve causes the working fluid to flow from the first hydraulic cylinder to the hydraulic pump motor, the working fluid returning from the first hydraulic cylinder can be distributed to the hydraulic pump motors in the plurality of hydraulic drive systems. Therefore, the plurality of hydraulic pump motors can regenerate the working fluid returning from the first hydraulic cylinder. Accordingly, the capacity of the first hydraulic pump motor can be set small, meaning that the size of the first hydraulic pump motor can be reduced.

Advantageous Effects of Invention

According to the present invention, it is possible to reduce the size of a hydraulic pump motor.

The above object, other objects, features, and advantages of the present invention will be made clear by the following detailed explanation of preferred embodiments with reference to the attached drawings.

DESCRIPTION OF EMBODIMENTS

Hereinafter, a hydraulic drive device 1 according to an embodiment of the present invention will be described with reference to the aforementioned drawings. Note that the concept of directions mentioned in the following description is used for the sake of explanation; the orientations, etc., of elements according to the invention are not limited to these directions. The hydraulic drive device 1 described below is merely one embodiment of the present invention. Thus, the present invention is not limited to the embodiment and may be subject to addition, deletion, and alteration within the scope of the essence of the invention.

Figure 1:
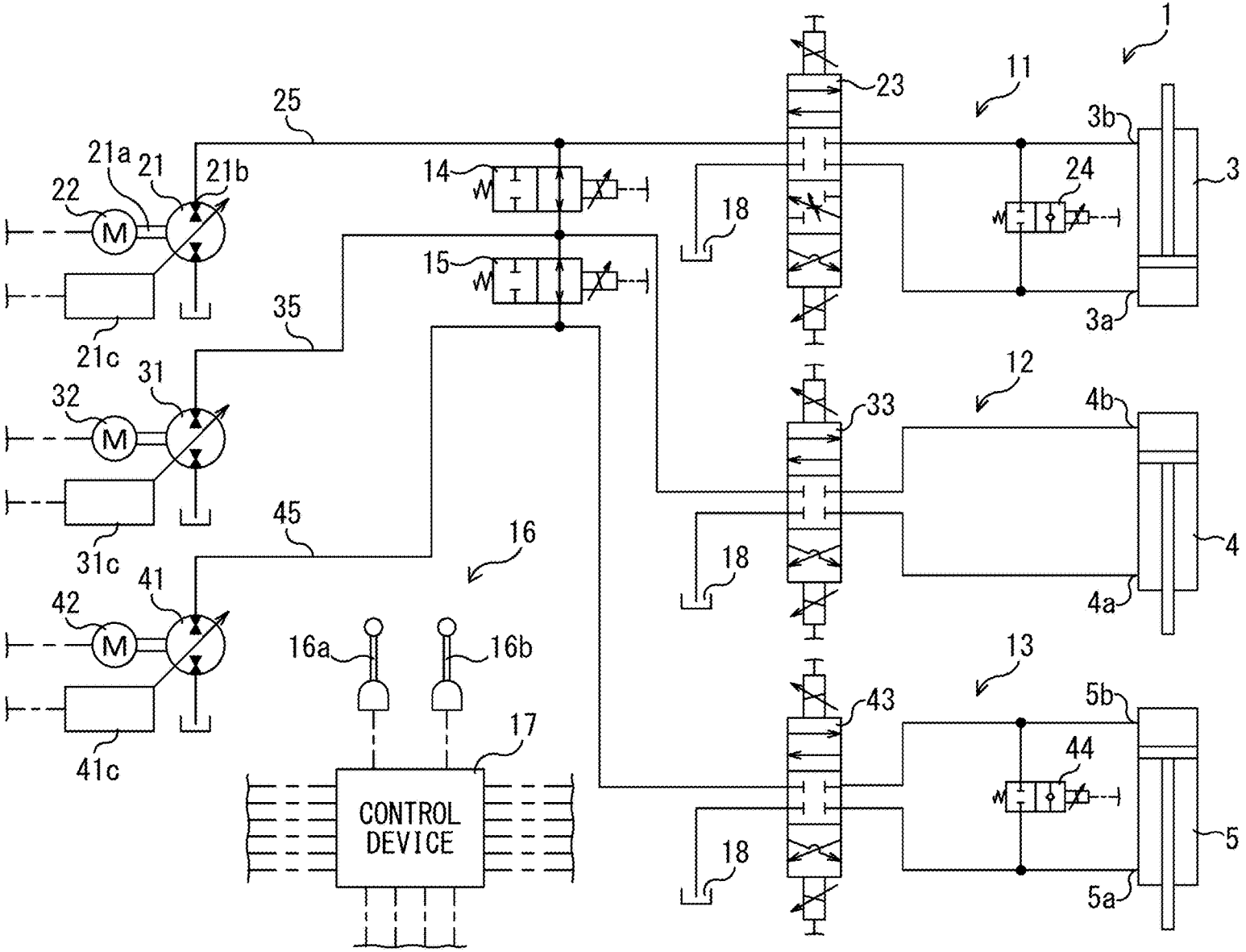
FIG. 1 is a circuit diagram illustrating the configuration of a hydraulic drive device according to the present embodiment.

The hydraulic drive device 1 illustrated in FIG. 1 is included, for example, in a work vehicle (not illustrated in the drawings). Examples of the work vehicle include construction vehicles such as hydraulic excavators and hydraulic cranes and industrial vehicles such as forklifts. In the present embodiment, the work vehicle is a hydraulic excavator. The hydraulic excavator includes a plurality of hydraulic cylinders 3 to 5 in order to move an attachment. In the present embodiment, the attachment of the hydraulic excavator is a bucket, and the hydraulic excavator includes at least: a boom cylinder 3, which is the first hydraulic cylinder; a bucket cylinder 4, which is the second hydraulic cylinder; and an arm cylinder 5, which is the third hydraulic cylinder. The hydraulic cylinders 3 to 5 are provided on the boom, the bucket, and the arm, respectively. The hydraulic excavator moves the bucket by extending and retracting the three hydraulic cylinders 3 to 5. Thus, the hydraulic excavator can perform various tasks.

<Hydraulic Drive Device>

The hydraulic drive device 1 drives the hydraulic cylinders 3 to 5. In the present embodiment, the hydraulic drive device 1 drives at least the boom cylinder 3, the bucket cylinder 4, and the arm cylinder 5 mentioned above. The hydraulic drive device 1 includes first to third hydraulic drive systems 11 to 13 and two communication valves 14, 15. Furthermore, the hydraulic drive device 1 includes an operation device 16 and a control device 17.

<Multiple Hydraulic Drive Systems>

The hydraulic drive systems 11 to 13 are provided in a one-to-one correspondence with the hydraulic cylinders 3 to 5. In the present embodiment, the first hydraulic drive system 11 is provided corresponding to the boom cylinder 3, the second hydraulic drive system 12 is provided corresponding to the bucket cylinder 4, and the third hydraulic drive system 13 is provided corresponding to the arm cylinder 5. Each of the hydraulic drive systems 11 to 13 supply a working fluid (for example, liquid such as oil and water) to a corresponding one of the hydraulic cylinders 3 to 5. The first to third hydraulic drive systems 11 to 13 include hydraulic pump motors 21, 31, 41, electric motors 22, 32, 42, and directional control valves 23, 33, 43. The first and third hydraulic drive systems 11, 13 further include recovery valves 24, 44. Hereinafter, the configurations of the first to third hydraulic drive systems 11 to 13 will be described in detail.

<First Hydraulic Drive System>

The first hydraulic drive system 11 supplies the working fluid to the boom cylinder 3. The first hydraulic drive system 11 regenerates, as electrical energy, the fluid energy of the working fluid drained from the boom cylinder 3. Furthermore, the first hydraulic drive system 11 recovers, to a rod-end port 3*b* of the boom cylinder 3, the working fluid drained from a head-end port 3*a* of the boom cylinder 3. The first hydraulic drive system 11 includes the first hydraulic pump motor 21, the first electric motor 22, and the first directional control valve 23, as mentioned above. The first hydraulic drive system 11 further includes the first recovery valve 24.

[First Hydraulic Pump Motor]

The first hydraulic pump motor 21 discharges the working fluid. Furthermore, when supplied with the working fluid, the first hydraulic pump motor 21 rotates. More specifically, the first hydraulic pump motor 21 incudes a shaft 21*a* and a pump port 21*b*. When the shaft 21*a* is rotatably driven, the first hydraulic pump motor 21 discharges the working fluid from the pump port 21*b*. On the other hand, when the working fluid is supplied to the pump port 21*b*, the first hydraulic pump motor 21 rotates the shaft 21*a*. In the present embodiment, the first hydraulic pump motor 21, which is a swash plate pump of the variable capacity type, incudes a regulator 21*c*. The regulator 21*c* changes the pump capacity of the first hydraulic pump motor 21 on the basis of a first capacity command that is input to the regulator 21.

[First Electric Motor]

The first electric motor 22 rotatably drives the first hydraulic pump motor 21 to discharge the working fluid from the first hydraulic pump motor 21. Furthermore, the first electric motor 22 generates power when rotatably driven by the first hydraulic pump motor 21. In other words, the first electric motor 22 works with the first hydraulic pump motor 21 to regenerate the fluid energy of the working fluid as electrical energy. More specifically, the first electric motor 22 is coupled to the shaft 21*a*. The first electric motor 22 rotatably drives the shaft 21*a* to discharge the working fluid from the pump port 21*b*. Furthermore, when the first hydraulic pump motor 21 rotatably drives the shaft 21*a*, the first electric motor 22 generates power. Moreover, the first electric motor 22 changes the rotational speed thereof according to a first rotational speed command that is input to the first electric motor 22.

[First Directional Control Valve]

The first directional control valve 23 is connected to the first hydraulic pump motor 21 via a pump passage 25. Furthermore, the first directional control valve 23 is connected to the boom cylinder 3. More specifically, the first directional control valve 23 is connected to each of the head-end port 3*a* and the rod-end port 3*b* of the boom cylinder 3. Moreover, the first directional control valve 23 is connected to a tank 18.

The first directional control valve 23 switches the flow direction of the working fluid flowing between the first hydraulic pump motor 21 and the boom cylinder 3 according to a first operation command that is input to the first directional control valve 23. More specifically, the first directional control valve 23 causes the working fluid to flow from the boom cylinder 3 to the first hydraulic pump motor 21 according to the first operation command that is input to the first directional control valve 23. Furthermore, according to the first operation command, the first directional control valve 23 causes the working fluid to flow from the first hydraulic pump motor 21 to the boom cylinder 3 (in the present embodiment, the head-end port 3*a* of the boom cylinder 3). In the present embodiment, the first directional control valve 23 causes the working fluid to flow in one of a head-end supply direction and a rod-end supply direction according to the first operation command that is input to the first directional control valve 23. The head-end supply direction is a direction in which the working fluid flows from the first hydraulic pump motor 21 to the head-end port 3*a*, and the rod-end supply direction is a direction in which the working fluid flows from the first hydraulic pump motor 21 to the rod-end port 3*b*. Furthermore, the first directional control valve 23 can block the path between the first hydraulic pump motor 21 and the boom cylinder 3. Moreover, the first directional control valve 23 controls the opening degree thereof according to the first operation command upon regeneration during which the first directional control valve 23 causes the working fluid to flow from the boom cylinder 3 to the first hydraulic pump motor 21.

[First Recovery Valve]

The first recovery valve 24 is connected to the head-end port 3*a* and the rod-end port 3*b* of the boom cylinder 3. The first recovery valve 24 places the head-end port 3*a* and the rod-end port 3*b* in communication according to a first recovery command. Furthermore, in the state where the head-end port 3*a* and the rod-end port 3*b* are in communication, the first recovery valve 24 allows the flow of the working fluid in a first recovery direction and blocks the opposite flow of the working fluid. The first recovery direction is the direction of the flow from the head-end port 3*a* to the rod-end port 3*b*. Thus, when supplying the working fluid to the rod-end port 3*b*, the first recovery valve 24 recovers, to the rod-end port 3*b*, the working fluid drained from the head-end port 3*a*.

<Second Hydraulic Drive System>

The second hydraulic drive system 12 supplies the working fluid to the bucket cylinder 4. The second hydraulic drive system 12 includes the second hydraulic pump motor 31, the second electric motor 32, and the second directional control valve 33, as mentioned above. Note that the second hydraulic pump motor 31 and the second electric motor 32 have substantially the same configurations as the first hydraulic pump motor 21 and the first electric motor 22 described above. Therefore, regarding the configurations of the second hydraulic pump motor 31 and the second electric motor 32, reference will be made to the above description of the first hydraulic pump motor 21 and the first electric motor 22, and detailed description of the second hydraulic pump motor 31 and the second electric motor 32 will be omitted. Note that a regulator 31*c* of the second hydraulic pump motor 31 changes the discharge capacity according to a second capacity command, and the second electric motor 32 changes the rotational speed according to a second rotational speed command.

[Second Directional Control Valve]

The second directional control valve 33 is connected to the second hydraulic pump motor 31 via a pump passage 35 and is also connected to the bucket cylinder 4. The second directional control valve 33 switches the flow direction of the working fluid flowing between the second hydraulic pump motor 31 and the bucket cylinder 4 according to a second operation command. More specifically, the second directional control valve 33 connects the second hydraulic pump motor 31 to one of a rod-end port 4*a* and a head-end port 4*b* of the bucket cylinder 4 according to the second operation command. Furthermore, the second directional control valve 33 connects the other of the rod-end port 4*a* and the head-end port 4*b* to the tank 18 according to the second operation command. Thus, the second directional control valve 33 causes the working fluid discharged from the second hydraulic pump motor 31 to flow to one of the rod-end port 4*a* and the head-end port 4*b*. Furthermore, the second directional control valve 33 can block the path between the second hydraulic pump motor 31 and the bucket cylinder 4.

<Third Hydraulic Drive System>

The third hydraulic drive system 13 supplies the working fluid to the arm cylinder 5. Furthermore, the third hydraulic drive system 13 recovers, to a head-end port 5*b* of the arm cylinder 5, the working fluid drained from a rod-end port 5*a* of the arm cylinder 5. The third hydraulic drive system 13 includes the third hydraulic pump motor 41, the third electric motor 42, and the third directional control valve 43, as mentioned above. The third hydraulic drive system 13 further includes a second recovery valve 44. Note that the third hydraulic pump motor 41 and the third electric motor 42 have substantially the same configurations as the first hydraulic pump motor 21 and the first electric motor 22 described above. Therefore, regarding the configurations of the third hydraulic pump motor 41 and the third electric motor 42, reference will be made to the above description of the first hydraulic pump motor 21 and the first electric motor 22, and detailed description of the third hydraulic pump motor 41 and the third electric motor 42 will be omitted. Note that a regulator 41*c* of the third hydraulic pump motor 41 changes the discharge capacity according to a third capacity command, and the third electric motor 42 changes the rotational speed according to a third rotational speed command.

[Third Directional Control Valve]

The third directional control valve 43 is connected to the third hydraulic pump motor 41 via a pump passage 45 and is also connected to the arm cylinder 5. The third directional control valve 43 switches the flow direction of the working fluid flowing between the third hydraulic pump motor 41 and the arm cylinder 5 according to a third operation command. Specifically, the third directional control valve 43 switches the destination of the working fluid flowing from the third hydraulic pump motor 41 to one of a rod-end port 5*a* and a head-end port 5*b* of the arm cylinder 5 according to the third operation command. Furthermore, the third directional control valve 43 connects the other of the rod-end port 5*a* and the head-end port 5*b* to the tank 18. Moreover, the third directional control valve 43 can block the path between the third hydraulic pump motor 41 and the arm cylinder 5 according to the third operation command.

[Second Recovery Valve]

The second recovery valve 44 is connected to the rod-end port 5*a* and the head-end port 5*b* of the arm cylinder 5. The second recovery valve 44 places the rod-end port 5*a* and the head-end port 5*b* in communication according to a second recovery command. Furthermore, in the state where the rod-end port 5*a* and the head-end port 5*b* are in communication, the second recovery valve 44 allows the flow of the working fluid in a second recovery direction and blocks the opposite flow of the working fluid. The second recovery direction is the direction of the flow from the rod-end port 5*a* to the head-end port 5*b*. Thus, when supplying the working fluid to the head-end port 5*b*, the second recovery valve 44 recovers, to the head-end port 5*b*, the working fluid drained from the rod-end port 5*a*.

<Communication Valve>

The two communication valves 14, 15 place the first to third hydraulic drive systems 11 to 13 in communication with each other according to communication commands that are input to the communication valves 14, 15. More specifically, the first communication valve 14 is connected to the pump passage 25 of the first hydraulic drive system 11 and the pump passage 35 of the second hydraulic drive system 12. The first communication valve 14 is opened according to a first communication command that is input thereto. As a result, the two pump passages 25, 35 are placed in communication, allowing the working fluid to flow back and forth between the pump passages 25, 35. The second communication valve 15 is connected to the pump passage 35 of the second hydraulic drive system 12 and the pump passage 45 of the third hydraulic drive system 13. The second communication valve 15 places the two pump passages 35, 45 in communication according to a second communication command that is input to the second communication valve 15. This allows the working fluid to flow back and forth between the pump passages 35, 45.

<Operation Device>

The operation device 16 is operated by a driver or the like in order to move the boom cylinder 3, the bucket cylinder 4, and the arm cylinder 5. More specifically, the operation device 16 can operate each of the cylinders 3 to 5. The operation device 16 outputs an operation signal corresponding to an operation direction and an operation amount (hereinafter referred to as "the operation status") of an operation (hereinafter referred to as "each operation" or "operations") to be performed on each of the cylinders 3 to 5. The operation device 16 includes a plurality of operation levers 16*a*, 16*b*, for example. In the present embodiment, the operation device 16 includes two operation levers 16*a*, 16*b*. The operation levers 16*a*, 16*b* can be operated (for example, tilted) in various directions. The operation device 16 outputs an operation signal representing the operation direction (for example, the direction of tilt) and the operation amount (for example, the amount of tilt) of each of the operation levers 16*a*, 16*b* as the operation status of each operation. Note that the operation device 16 may take another form such as an operation panel and may output an operation signal according to an operation performed on the operation panel or the like or a program stored in advance.

<Control Device>

The control device 17 receives the operation signal from the operation device 16. Subsequently, the control device 17 controls the operations of the directional control valves 23, 33, 43 by outputting operation commands to the first to third hydraulic drive systems 11 to 13 according to the operation statuses of the operations. More specifically, the control device 17 actuates the first directional control valve 23 by outputting the first operation command according to the operation status of a first operation that is an operation for the boom cylinder 3. Furthermore, the control device 17 actuates the second directional control valve 33 by outputting the second operation command according to the operation status of a second operation that is an operation for the bucket cylinder 4. Moreover, the control device 17 actuates the third directional control valve 43 by outputting the third operation command according to the operation status of a third operation that is an operation for the arm cylinder 5.

The control device 17 actuates the first recovery valve 24 by outputting the first recovery command. The control device 17 actuates the second recovery valve 44 by outputting the second recovery command. The control device 17 outputs the first and second communication commands according to the operation statuses of the first to third operations. Thus, the control device 17 opens and closes the first and second communication valves 14, 15.

By controlling the movement of the electric motors 22, 32, 42 and the regulators 21*c*, 31*c*, 41*c*, the control device 17 controls the discharge flow rates and the suction flow rates of the hydraulic pump motors 21, 31, 41. For example, the control device 17 calculates the discharge flow rates or the suction flow rates of the hydraulic pump motors 21, 31, 41 according to the operation statuses of the operations. The control device 17 calculates the rotational speeds of the electric motors 22, 32, 42 and the pump capacities of the hydraulic pump motors 21, 31, 41 on the basis of the discharge flow rates or the suction flow rates calculated. Subsequently, the control device 17 outputs the first to third rotational speed commands corresponding to the rotational speeds to the electric motors 22, 32, 42 and outputs the first to third capacity commands corresponding to the pump capacities to the hydraulic pump motors 21, 31, 41. Thus, the control device 17 calculates the discharge flow rates or the suction flow rates of the hydraulic pump motors 21, 31, 41 according to the operation statuses of the operations.

<Operation of Hydraulic Drive Device>

In the hydraulic drive device 1, when the operation device 16 is operated (in the present embodiment, when the operation levers 16*a*, 16*b* are operated), the operation device 16 outputs the operation signal corresponding to the operation status of each operation. When the operation signal is output, the control device 17 causes the cylinders 3 to 5 to be extended and retracted in directions corresponding to the operation directions of the operations and at speeds corresponding to the operation amounts of the operations.

More specifically, the control device 17 outputs the rotational speed commands corresponding to the operations statuses of the operations to the electric motors 22, 32, 42. Furthermore, the control device 17 outputs the capacity commands corresponding to the operation statuses of the operations to the hydraulic pump motors 21, 31, 41. Thus, the control device 17 causes the electric motors 22, 32, 42 and the hydraulic pump motors 21, 31, 41 to discharge or suction the working fluid at flow rates corresponding to the operation amounts of the operations according to the operation directions of the operations. Moreover, the control device 17 outputs the operation commands corresponding to the operation statuses of the operations to the hydraulic drive systems 11 to 13. As a result, the directional control valves 23, 33, 43 connect the hydraulic pump motors 21, 31, 41 to the corresponding hydraulic cylinders 3 to 5. Accordingly, the cylinders 3 to 5 are extended and retracted in directions corresponding to the operation directions of the operations at speeds corresponding to the operation amounts of the operations. The extension and retraction of the cylinders by the operations will be described below.

[Operation to Extend Cylinders]

For example, when the first operation (specifically, a boom lifting operation) is performed on the operation device 16 in order to extend the boom cylinder 3, the control device 17 outputs the first rotational speed command and the first capacity command corresponding to the operation status of the first operation. Accordingly, the working fluid is discharged from the first hydraulic pump motor 21 at a flow rate corresponding to the operation amount of the first operation. Furthermore, the control device 17 outputs the first operation command to the first hydraulic drive system 11 according to the operation status of the first operation. Accordingly, the first directional control valve 23 connects the first hydraulic pump motor 21 to the head-end port 3*a* of the boom cylinder 3. Thus, the flow direction of the working fluid is switched to the head-end supply direction. Note that in the present embodiment, the opening degree between the first hydraulic pump motor 21 and the head-end port 3*a* is a fully-open opening degree during the boom lifting operation. Therefore, the working fluid flows in the head-end supply direction at a flow rate corresponding to the operation amount of the first operation. Thus, the boom cylinder 3 is extended at a speed corresponding to the operation amount of the first operation.

Furthermore, when the operation amount of the first operation exceeds a predetermined boom merge threshold value, the control device 17 opens the first communication valve 14. Moreover, the control device 17 outputs the second rotational speed command and the second capacity command that correspond to the operation status of the first operation. As a result, the working fluid is discharged from not only the first hydraulic pump motor 21, but also the second hydraulic pump motor 31. Streams of the working fluid discharged from the hydraulic pump motors 21, 31 merge together at the first communication valve 14 and are supplied to the boom cylinder 3 (more specifically, the head-end port 3*a*). This allows the boom cylinder 3 to be extended at a greater speed. Therefore, it is possible to reduce the size of the first hydraulic pump motor 21.

Furthermore, in the hydraulic drive device 1, when the second operation (specifically, a bucket-in operation) is performed on the operation device 16 in order to extend the bucket cylinder 4, the control device 17 outputs the second rotational speed command and the second capacity command corresponding to the operation status of the second operation. Moreover, the control device 17 outputs the second operation command corresponding to the operation status of the second operation to the second hydraulic drive system 12. Thus, the bucket cylinder 4 is extended at a speed corresponding to the operation amount of the second operation.

Furthermore, when the third operation (specifically, an arm-in operation) is performed on the operation device 16 in order to extend the arm cylinder 5, the control device 17 operates as follows. Specifically, the control device 17 calculates the posture of the arm on the basis of the angle of each of the boom and the arm. For example, an angle sensor is provided on each of the boom and the arm. The control device 17 calculates the posture of the arm on the basis of detection results obtained from the angle sensors. Subsequently, on the basis of a calculation result, the control device 17 determines whether the empty weight of the arm acts in the direction of extension; in other words, the control device 17 makes an empty weight extension determination. Note that the control device 17 may make the empty weight extension determination on the basis of the hydraulic pressure on the rod-end port 5*a* and the head-end port 5*b*.

When the empty weight of the arm does not act on the arm cylinder 5 in the direction of extension, the control device 17 outputs the third operation command corresponding to the operation status of the third operation to the third hydraulic drive system 13. Accordingly, the third directional control valve 43 connects the rod-end port 5*a* and the tank 18 Furthermore, the control device 17 controls the opening degree between the rod-end port 5*a* and the tank 18 according to the operation amount of the third operation. Moreover, the control device 17 outputs the third rotational speed command and the third capacity command that correspond to the operation status of the third operation. Accordingly, the working fluid is supplied from the third hydraulic pump motor 41 to the head-end port 5*b* at a flow rate corresponding to the operation amount of the third operation, and the working fluid is drained from the rod-end port 5*a* to the tank 18 via the third directional control valve 43. Thus, the arm cylinder 5 is extended at a speed corresponding to the operation amount of the third operation. Note that when the operation amount of the third operation increases, the control device 17 opens the second communication valve 15 to cause the working fluid from the second hydraulic pump motor 31 to merge with the working fluid from the third hydraulic pump motor 41. This allows the arm cylinder 5 to be extended at a greater speed. Moreover, when the operation amount of the third operation further increases, the control device 17 opens the first communication valve 14 to cause the working fluid from the first hydraulic pump motor 21 to merge with the working fluid from the second hydraulic pump motor 31. This allows the arm cylinder 5 to be extended at a still greater speed.

On the other hand, when the empty weight of the arm acts on the arm cylinder 5 in the direction of extension, the control device 17 performs an arm recovery process. Specifically, the control device 17 opens the second recovery valve 44 by outputting the second recovery command to the second recovery valve 44. As a result, the rod-end port 5*a* and the head-end port 5*b* are placed in communication. The control device 17 causes the third directional control valve 43 to block the path between the third hydraulic pump motor 41 and the arm cylinder 5. In other words, the third directional control valve 43 blocks the paths between the rod-end port 5*a*, the head-end port 5*b*, the third hydraulic pump motor 41, and the tank 18. Thus, the working fluid drained from the rod-end port 5*a* can be recovered to the head-end port 5*b*. Note that when there is a shortage of the working fluid, the working fluid is suctioned up to the head-end port 5*b* from a make-up circuit not illustrated in the drawings. Thus, the arm cylinder 5 is extended at a speed corresponding to the operation amount of the third operation.

[Operation to Retract Cylinders]

When the second operation (specifically, a bucket-out operation) is performed on the operation device 16 in order to retract the bucket cylinder 4, the control device 17 outputs the second rotational speed command and the second capacity command corresponding to the operation status of the second operation. Furthermore, the control device 17 outputs the second operation command corresponding to the operation status of the second operation to the second hydraulic drive system 12. As a result, the second directional control valve 33 connects the second hydraulic pump motor 31 to the rod-end port 4*a* of the bucket cylinder 4. Thus, the bucket cylinder 4 is retracted at a speed corresponding to the operation amount of the second operation.

Furthermore, when the third operation (specifically, an arm-out operation) is performed on the operation device 16 in order to retract the arm cylinder 5, the control device 17 outputs the third rotational speed command and the third capacity command corresponding to the operation status of the third operation. Moreover, the control device 17 outputs the third operation command corresponding to the operation status of the third operation to the third hydraulic drive system 13. As a result, the third directional control valve 43 connects the third hydraulic pump motor 41 to the rod-end port 5*a* of the arm cylinder 5. Thus, the arm cylinder 5 is retracted at a speed corresponding to the operation amount of the third operation.

Furthermore, when the operation amount of the third operation exceeds a predetermined arm merge threshold value, the control device 17 opens the second communication valve 15. Moreover, the control device 17 outputs the second rotational speed command and the second capacity command that correspond to the operation status of the third operation. As a result, the working fluid is discharged from not only the third hydraulic pump motor 41, but also the second hydraulic pump motor 31. Streams of the working fluid discharged from the hydraulic pump motors 31, 41 merge together at the second communication valve 15 and are supplied to the arm cylinder 5. This allows the arm cylinder 5 to be retracted at a greater speed.

[Operation to Retract Boom Cylinder]

Figure 2:
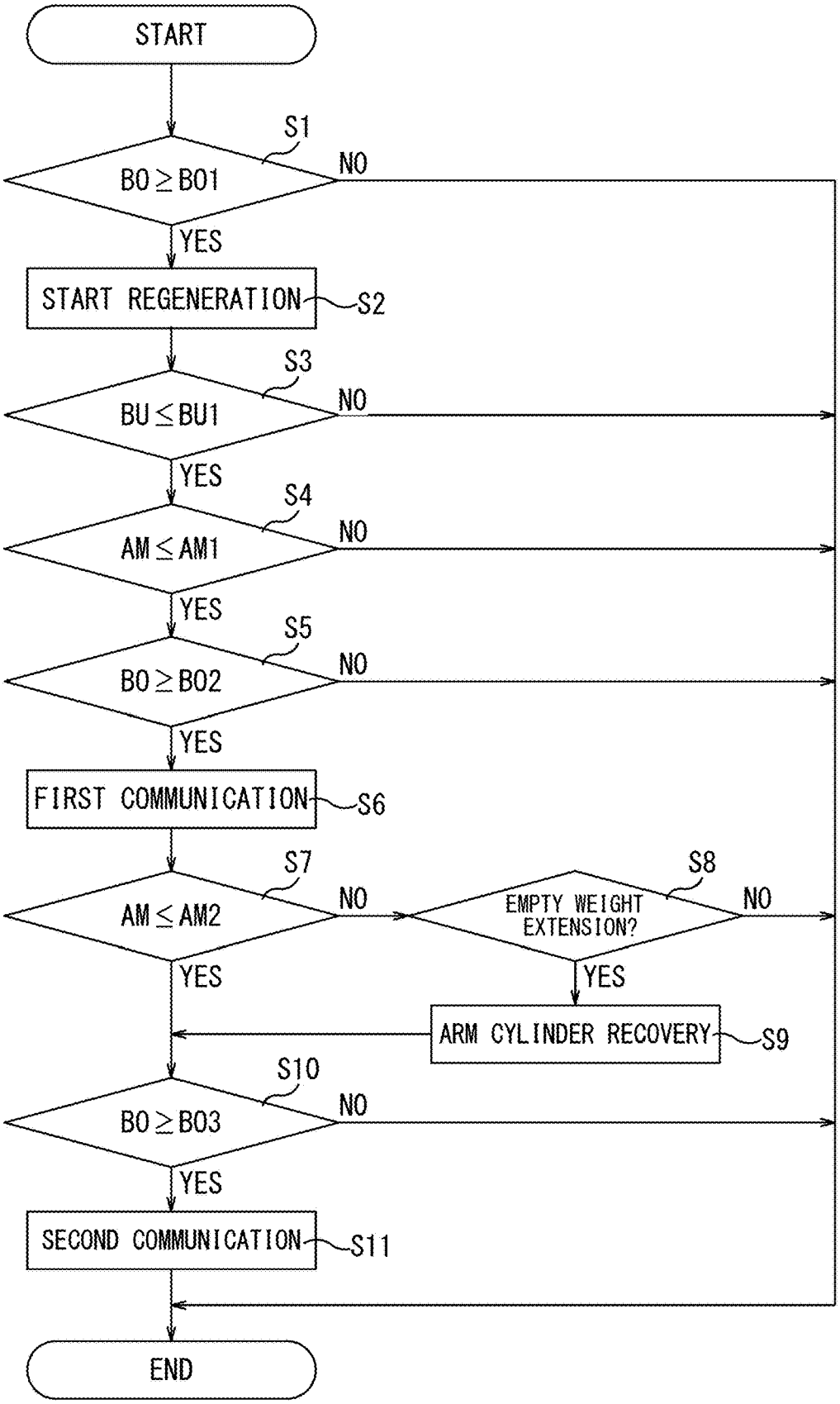
FIG. 2 is a flowchart illustrating the flow of steps in a boom regeneration method performed by the hydraulic drive device illustrated in FIG. 1.

Furthermore, when the first operation (specifically, a boom lowering operation) is performed on the operation device 16 in order to retract the boom cylinder 3, the control device 17 performs regeneration control. Specifically, in the hydraulic drive device 1, the fluid energy of the working fluid is regenerated as electrical energy when retracting the boom cylinder 3 in order to lower the boom. Furthermore, the control device 17 performs recovery control along with the regeneration control. Specifically, in the hydraulic drive device 1, the working fluid drained from the head-end port 3*a* is recovered to the rod-end port 3*b*. Furthermore, in the hydraulic drive device 1, the number of hydraulic pump motors 21, 31, 41 to be used in the regeneration is changed depending on the operation statuses (mainly the operation amounts) of the first to third operations. Hereinafter, the regeneration control of the control device 17 will be described with reference to the flow illustrated in FIG. 2. When the first operation is a boom lowering operation, the control device 17 transitions to Step S1.

In Step S1, which is a regeneration determination step, whether an operation amount BO of the first operation is greater than or equal to a predetermined regeneration start threshold value BO1 (that is, BO≥BO1) is determined. When the operation amount BO of the first operation is less than the regeneration start threshold value BO1 (for example, when the operation amount is zero), the energy regeneration is determined to be unnecessary. In this situation, the regeneration control ends. On the other hand, when the operation amount BO of the first operation is greater than or equal to the regeneration start threshold value BO1, the processing transitions to Step S2.

In Step S2, which is a regeneration start step, the energy regeneration is performed using the first hydraulic pump motor 21. Specifically, the control device 17 outputs the first operation command corresponding to the operation status of the first operation to the first hydraulic drive system 11. Accordingly, the first directional control valve 23 connects the head-end port 3*a* of the boom cylinder 3 and the first hydraulic pump motor 21. At this time, the control device 17 keeps the communication valves 14, 15 closed. As a result, the working fluid flows back from the head-end port 3*a* of the boom cylinder 3 to the first hydraulic pump motor 21. The first hydraulic pump motor 21 is rotatably driven by the working fluid flowing thereto. This causes the electric motor 22 to generate power. Therefore, the fluid energy of the working fluid is regenerated as electrical energy using the first hydraulic pump motor 21.

Furthermore, upon regeneration, the control device 17 outputs the first operation command and also outputs the first recovery command to the first recovery valve 24. Accordingly, the first recovery valve 24 is opened, and thus the rod-end port 3*b* and the head-end port 3*a* are placed in communication. Moreover, by outputting the first operation command corresponding to the operation amount of the first operation, the control device 17 performs control to set the opening degree of the first directional control valve 23 to an opening degree corresponding to the first operation command. Thus, the flow rate of the working fluid returning from the head-end port 3*a* to the first hydraulic pump motor 21 can be limited, and part of the working fluid drained from the head-end port 3*a* can be recovered to the rod-end port 3*b*. Furthermore, by outputting the first rotational speed command and the first capacity command according to the operation amount of the first operation, the control device 17 performs control to set the suction flow rate of the working fluid that is suctioned into the first hydraulic pump motor 21 to a flow rate corresponding to the operation amount of the first operation. Thus, in the first electric motor 22, power corresponding to the operation amount of the first operation is generated. When the fluid energy of the working fluid is regenerated as electrical energy using the first hydraulic pump motor 21, the processing transitions to Step S3.

In Step S3, which is a bucket drive determination step, whether an operation amount BU of the second operation is less than or equal to a first predetermined value BU1 (that is, BU≤BU1) is determined. When the operation amount BU of the second operation is greater than the first predetermined value BU1 (for example, when the bucket cylinder 4 is being actuated), the flow ends. Therefore, in the regeneration control, energy regeneration is performed using only the first hydraulic pump motor 21. On the other hand, when the operation amount BU of the second operation is less than or equal to the first predetermined value BU1 (for example, when the operation amount is zero), the processing transitions to Step S4.

In Step S4, which is a merge determination step, whether an operation amount AM of the third operation is less than or equal to the arm merge threshold value AM1 mentioned above (that is, AM≤AM1) is determined. When the operation amount AM of the third operation is greater than the arm merge threshold value AM1 (for example, when the arm cylinder 5 is quickly extended), the flow ends. Therefore, in the regeneration control, energy regeneration is performed using only the first hydraulic pump motor 21. On the other hand, when the operation amount AM of the third operation is less than or equal to the arm merge threshold value AM1, the processing proceeds to Step S5.

In Step S5, which is a first operation amount determination step, the operation amount BO of the first operation is greater than or equal to a predetermined first communication threshold value BO2 (>BO1) (that is, BO≥BO2) is determined. When the operation amount BO of the first operation is less than the first communication threshold value BO2, the flow ends. Therefore, in the regeneration control, energy regeneration is performed using only the first hydraulic pump motor 21. On the other hand, when the operation amount BO of the first operation is greater than or equal to the first communication threshold value BO2, the processing transitions to Step S6.

In Step S6, which is a first communication step, the control device 17 outputs the first communication command to the first communication valve 14. Accordingly, the first communication valve 14 is opened, and thus the head-end port 3*a* of the boom cylinder 3 is also connected to the second hydraulic pump motor 31. Furthermore, the control device 17 keeps the path between the second hydraulic pump motor 31 and the bucket cylinder 4 blocked by the second directional control valve 33. Accordingly, the working fluid drained from the head-end port 3*a* is also supplied to the second hydraulic pump motor 31. Moreover, the control device 17 outputs the first and second rotational speed commands and the first and second capacity commands that correspond to the operation status of the first operation. Accordingly, the suction flow rate of the working fluid that is suctioned into each of the first and second hydraulic pump motors 21, 31 is set to a flow rate corresponding to the operation amount of the first operation. Thus, in the first and second electric motors 22, 32, power corresponding to the operation amount of the first operation is generated. When the fluid energy of the working fluid is regenerated as electrical energy using the first and second hydraulic pump motors 21, 31, the processing transitions to Step S7.

In Step S7, which is an arm drive determination step, whether the operation amount AM of the third operation is less than or equal to a second predetermined value AM2 (<AM1) (that is, AM≤AM2) is determined. When the operation amount AM of the third operation is greater than the second predetermined value AM2 (for example, when the arm cylinder 5 is to be actuated), the processing transitions to Step S8. On the other hand, when the operation amount AM of the third operation is less than or equal to the second predetermined value AM2 (for example, when the operation amount is zero), the processing transitions to Step S10.

In Step S8, which is an empty weight extension determination step, whether the arm cylinder 5 is to be extended under load is determined. More specifically, the control device 17 determines whether the empty weight of the arm is acting in the direction of extension of the arm cylinder 5 in the arm-in operation, as in the empty weight extension determination described above. When the control device 17 determines that the third operation is not an arm-in operation or the empty weight of the arm is not acting in the direction of extension of the arm cylinder 5, the flow ends. Therefore, in the regeneration control, energy regeneration is performed using the first and second hydraulic pump motors 21, 31. On the other hand, when the control device 17 determines that the third operation is an arm-in operation and the empty weight of the arm is acting in the direction of extension of the arm cylinder 5, the processing transitions to Step S9.

In Step S9, which is an arm cylinder recovery step, the control device 17 performs the arm recovery process described above. Specifically, the control device 17 opens the second recovery valve 44 by outputting the second recovery command to the second recovery valve 44. As a result, the working fluid drained from the rod-end port 5*a* to the tank 18 is recovered to the head-end port 5*b*. When the recovery occurs, the flow ends. Therefore, in the regeneration control, energy regeneration is performed using the first and second hydraulic pump motors 21, 31.

In Step S10, which is a second operation amount determination step, the operation amount BO of the first operation is greater than or equal to a predetermined second communication threshold value BO3 (>BO2) (that is, BO≥BO3) is determined. When the operation amount BO of the first operation is less than the second communication threshold value BO3, the flow ends. Therefore, in the regeneration control, energy regeneration is performed using the first and second hydraulic pump motors 21, 31. On the other hand, when the operation amount BO of the first operation is greater than or equal to the second communication threshold value BO3, the processing transitions to Step S11.

In the second communication step, the control device 17 outputs the second communication command to the second communication valve 15. Accordingly, the second communication valve 15 is opened, and thus the head-end port 3*a* of the boom cylinder 3 is also connected to the third hydraulic pump motor 41. Furthermore, the control device 17 keeps the path between the third hydraulic pump motor 41 and the arm cylinder 5 blocked by the third directional control valve 43. Accordingly, the working fluid drained from the head-end port 3*a* is also supplied to the third hydraulic pump motor 41. Moreover, the control device 17 outputs the first to third rotational speed commands and the first to third capacity commands that correspond to the operation status of the first operation. Accordingly, the suction flow rate of the working fluid that is suctioned into each of the first to third hydraulic pump motors 21, 31, 41 is set to a flow rate corresponding to the operation amount of the first operation. Thus, in the first to third electric motor 22, 32, 42, power corresponding to the operation amount of the first operation is generated. Therefore, in the regeneration control, energy regeneration is performed using the first to third hydraulic pump motors 21, 31, 41. Subsequently, the flow ends.

Note that there are cases where a power running operation is performed during the boom lowering operation. In the case where the power running operation is performed, the control device 17 performs power running control described below. Note that on the basis of the hydraulic pressure at each of the head-end port 3*a* and the rod-end port 3*b* of the boom cylinder 3, for example, the control device 17 determines whether the operation being performed is the power running operation. In the power running operation, the control device 17 outputs the first rotational speed command and the first capacity command that correspond to the operation status of the first operation. As a result, the working fluid is discharged from the first hydraulic pump motor 21. Furthermore, the control device 17 causes the first directional control valve 23 to connect the rod-end port 3*b* of the boom cylinder 3 and the first hydraulic pump motor 21 and sets the opening degree between the rod-end port 3*b* and the first hydraulic pump motor 21 to an opening degree corresponding to the operation amount of the first operation. As a result, the working fluid flows in the rod-end supply direction at a flow rate corresponding to the operation amount of the first operation. Therefore, the control device 17 can retract the boom cylinder 3 at a speed corresponding to the operation amount of the first operation.

The hydraulic drive device 1 according to the present embodiment includes the first communication valve 14 that places the first and second hydraulic drive systems 11, 12 in communication with each other according to the first communication command that is input to the first communication valve 14. Therefore, when the first communication command is output to the first communication valve 14 at the time that the first directional control valve 23 causes the working fluid to flow from the boom cylinder 3 to the first hydraulic pump motor 21, the working fluid returning from the boom cylinder 3 can be distributed to the first and second hydraulic pump motors 21, 31. Therefore, the first and second hydraulic pump motors 21, 31 can regenerate the working fluid returning from the boom cylinder 3. Accordingly, the capacity of the first hydraulic pump motor 21 can be set small, meaning that the size of the first hydraulic pump motor 21 can be reduced.

Furthermore, the hydraulic drive device 1 according to the present embodiment includes the first and second communication valves 14, 15 that place the first to third hydraulic drive systems 11 to 13 in communication with each other according to the communication commands that are input to the first and second communication valves 14, 15. Therefore, when the communication commands are output to the first and second communication valves 14, 15 at the time that the first directional control valve 23 causes the working fluid to return from the boom cylinder 3 to the first hydraulic pump motor 21, the working fluid returning from the boom cylinder 3 can be distributed to the first to third hydraulic pump motors 21, 31, 41. Therefore, the working fluid returning from the boom cylinder 3 can be regenerated at the first to third hydraulic pump motors 21, 31, 41. Accordingly, the capacity of the first hydraulic pump motor 21 can be set small, meaning that the size of the first hydraulic pump motor 21 can be reduced.

Furthermore, in the hydraulic drive device 1 according to the present embodiment, the communication valves 14, 15 are connected to the pump passages 25, 35, 45 in the hydraulic drive systems 11 to 13 to be placed in communication. Therefore, it is possible to cause an increased amount of the working fluid to flow to the hydraulic pump motors 31, 41 by blocking the second and third directional control valves 33, 43 upon regeneration. This allows for improved regeneration efficiency in the hydraulic drive device 1.

Furthermore, in the hydraulic drive device 1 according to the present embodiment, the first regeneration valve 24 can recover, to the rod-end port 3*b*, the working fluid drained from the head-end port 3*a*. Thus, the flow rate of the working fluid returning from the boom cylinder 3 to the first hydraulic pump motor 21 can be reduced, meaning that the size of the first hydraulic pump motor 21 can be further reduced.

Furthermore, in the hydraulic drive device 1 according to the present embodiment, the opening degree of the first directional control valve 23 is controlled according to the first operation command corresponding to the operation amount of the first operation, and the communication valves 14, 15 are actuated according to the operation amount of the first operation. Therefore, both the opening degree of the first directional control valve 23 and the communication through the communication valves 14, 15 are controlled according to the operation amount of the first operation. Therefore, when the first directional control valve 23 is opened and the flow rate of the returning working fluid increases according to the operation amount of the first operation, the hydraulic drive systems 11 to 13 can be placed in communication so that the working fluid can be distributed and supplied to the first to third hydraulic pump motors 21, 31, 41. Thus, it is possible to minimize the reduction in regeneration efficiency that is caused due to the failure to completely regenerate energy with the first hydraulic pump motor 21.

Furthermore, in the hydraulic drive device 1 according to the present embodiment, the control device 17 outputs the first recovery command to the first recovery valve 24 upon regeneration. While part of the working fluid drained from the head-end port 3*a* of the boom cylinder 3 is recovered to the rod-end port 3*b*, the remaining working fluid can be used for regeneration. Accordingly, the flow rate of the working fluid returning to the first hydraulic pump motor 21 can be reduced, meaning that the size of the first hydraulic pump motor 21 can be reduced.

Furthermore, in the hydraulic drive device 1 according to the present embodiment, when the operation amount of the first operation is greater than or equal to the first communication threshold value and the operation amount of the second operation is less than the first predetermined value upon regeneration, the first communication valve 14 is opened. Therefore, when the flow rate of the working fluid returning from the boom cylinder 3 is high and the operation amount of the second operation is small, the working fluid returning from the boom cylinder 3 can be distributed to the first and second hydraulic drive systems 11, 12. Thus, the flow rate of the working fluid returning to the first hydraulic pump motor 21 can be reduced upon regeneration. Therefore, it is possible to reduce the size of the first hydraulic pump motor 21. Furthermore, since the regeneration is performed with the first and second hydraulic pump motors 21, 31, an increased amount of the fluid energy can be regenerated as electrical energy.

Furthermore, in the hydraulic drive device 1 according to the present embodiment, when the operation amount of the first operation is greater than or equal to the second communication threshold value and the operation amount of the third operation is less than the second predetermined value upon regeneration, the second communication valve 15 is also opened. Therefore, when the flow rate of the working fluid returning from the boom cylinder 3 is high and the operation amounts of the second and third operations are small, the working fluid returning from the boom cylinder 3 can be distributed to the first to third hydraulic pump motors 21, 31, 41. Thus, the flow rate of the working fluid returning to the first hydraulic pump motor 21 can be reduced upon regeneration. Therefore, it is possible to reduce the size of the first hydraulic pump motor 21. Furthermore, since the regeneration is performed with the first to third hydraulic pump motors 21, 31, 41, an increased amount of the fluid energy can be regenerated as electrical energy.

Furthermore, in the hydraulic drive device 1 according to the present embodiment, when the arm cylinder 5 is extended under load, the second recovery valve 44 is opened. Therefore, part of the working fluid drained from the rod-end port 5*a* of the arm cylinder 5 can be recovered to the head-end port 5*b*.

Furthermore, with the hydraulic drive device 1 according to the present embodiment, it is possible to achieve the above-described functions in construction equipment or the like including a boom, a bucket, and an arm.

OTHER EMBODIMENTS

The hydraulic drive device 1 according to the present embodiment may be applied to construction vehicles, industrial vehicles, and the like other than hydraulic excavators, and may be applied to other work equipment. The hydraulic drive device 1 may be applied to any vehicles and equipment in which a working fluid is supplied to drive a plurality of hydraulic cylinders. The number of hydraulic cylinders in the hydraulic drive device 1 may be two or may be four or more. Note that when there are two hydraulic cylinders, the number of communication valves is one. The number of hydraulic drive systems to be included in the hydraulic drive device 1 does not necessarily need to be equal to the number of hydraulic cylinders. Furthermore, the hydraulic cylinders 3 to 5 are not limited to the boom cylinder 3, the bucket cylinder 4, and the arm cylinder 5 and may be other hydraulic cylinders. Furthermore, the configurations of the hydraulic drive systems 11 to 13 are not limited to those described above; other valves such as relief valves, check valves, and electromagnetic proportional valves may be included.

In the hydraulic drive device 1 according to the present embodiment, the method for determining the number of hydraulic pump motors 21, 31, 41 to be used in the regeneration control is not limited to the flow described above. Furthermore, the first and third hydraulic drive systems 11, 13 do not necessarily need to include the recovery valves 24, 44, respectively. The first hydraulic drive system 11 may supply the working fluid to a hydraulic cylinder other than the boom cylinder 3. The same is true for the second and third hydraulic drive systems 12, 13. The operation amount of each operation is not necessarily limited to the amount of operation performed on the operation levers 16*a*, 16*b*, and may be values or the like corresponding to the amount of operation performed on the operation levers 16*a*, 16*b*. Note that the first to third hydraulic pump motors 21, 31, 41 may be pumps of the fixed capacity or may be swash plate pumps, gear pumps, and the like. When the first to third hydraulic pump motors 21, 31, 41 are pumps of the fixed capacity, the control device 17 controls the discharge flow rate and the suction flow rate using the rotational speeds of the electric motors 22, 32, 42.

EXEMPLARY EMBODIMENTS

A hydraulic drive device according to the first aspect supplies a working fluid to a plurality of hydraulic cylinders including a first hydraulic cylinder and includes: a plurality of hydraulic drive systems that are respectively associated with the plurality of hydraulic cylinders and each of which supplies the working fluid to a corresponding one of the plurality of hydraulic cylinders; and one or more communication valves that place the plurality of hydraulic drive systems in communication with each other according to a communication command that is input to the one or more communication valves. Each of the plurality of hydraulic drive systems includes: a hydraulic pump motor that discharges the working fluid and when supplied with the working fluid, rotates; an electric motor that rotatably drives the hydraulic pump motor to cause the working fluid to be discharged from the hydraulic pump motor, and generates power by being rotatably driven by the hydraulic pump motor; and a directional control valve that switches, according to an operation command, a flow direction of the working fluid flowing between the hydraulic pump motor and a corresponding one of the plurality of hydraulic cylinders. A first hydraulic drive system that is one of the plurality of hydraulic drive systems that is associated with the first hydraulic cylinder includes a first directional control valve that is the directional control valve. The first directional control valve causes the working fluid to flow from the first hydraulic cylinder to the hydraulic pump motor according to a first operation command that is input to the first directional control valve.

According to the first aspect, one or more communication valves are provided that place the plurality of hydraulic drive systems in communication with each other according to the communication command that is input to the communication valves. Therefore, when the communication command is output to the communication valve at the time that the first directional control valve causes the working fluid to flow from the first hydraulic cylinder to the hydraulic pump motor, the working fluid returning from the first hydraulic cylinder can be distributed to the hydraulic pump motors in the plurality of hydraulic drive systems. Therefore, the working fluid returning from the first hydraulic cylinder can be used for regeneration at the plurality of hydraulic pump motors. Accordingly, the capacity of the first hydraulic pump motor can be set small, meaning that the size of the first hydraulic pump motor can be reduced.

In the hydraulic drive device according to the second aspect, in the hydraulic drive device according to the first aspect, the directional control valve may be connected to the hydraulic pump motor via a pump passage in a corresponding one of the plurality of hydraulic drive systems, and may be capable of blocking a path between the hydraulic pump motor and a corresponding one of the plurality of hydraulic cylinders, and each of the one or more communication valves may be connected to the pump passage in a corresponding one of the plurality of hydraulic drive systems to be placed in communication.

According to this aspect, the communication valves are connected to the pump passages in the hydraulic drive systems to be placed in communication. Therefore, it is possible to cause an increased amount of the working fluid to flow to the hydraulic pump motors by blocking the directional control valves in the hydraulic drive systems other than the first hydraulic drive system upon regeneration. This allows for improved regeneration efficiency in the hydraulic drive device.

In the hydraulic drive device according to the third aspect, in the hydraulic drive device according to the first or second aspect, the first hydraulic drive system may include a first recovery valve that is connected to a rod-end port and a head-end port of the first hydraulic cylinder and recovers the working fluid by placing the head-end port and the rod-end port in communication according to a first recovery command.

According to this aspect, the first recovery valve can recover, to the rod-end port, the working fluid drained from the head-end port. Thus, the flow rate of the working fluid returning from the first hydraulic cylinder to the first hydraulic pump motor can be reduced, meaning that the size of the first hydraulic pump motor can be further reduced.

In the hydraulic drive device according to the fourth aspect, in the hydraulic drive device according to one of the first to third aspects, a control device may be further included that outputs, to the first hydraulic drive system, the first operation command corresponding to an operation amount of a first operation that is an operation for the first hydraulic cylinder, an opening degree of the first directional control valve may be controlled according to the first operation command upon regeneration during which the working fluid flows from the first hydraulic cylinder to the hydraulic pump motor, and the control device may output the communication command according to the operation amount of the first operation.

According to this aspect, the opening degree of the first directional control valve is controlled according to the first operation command corresponding to the operation amount of the first operation, and the communication valve is actuated according to the operation amount of the first operation. Therefore, both the opening degree of the first directional control valve and the communication through the communication valve are controlled according to the operation amount of the first operation. Therefore, when the first directional control valve is opened and the flow rate of the returning working fluid increases according to the operation amount of the first operation, the hydraulic drive systems can be placed in communication so that the working fluid can be distributed and supplied to the hydraulic pump motors. Thus, it is possible to minimize the reduction in regeneration efficiency that is caused due to the failure to completely regenerate energy with a single hydraulic pump motor.

In the hydraulic drive device according to the fifth aspect, in the hydraulic drive device according to the fourth aspect, the first hydraulic drive system may include a first recovery valve that is connected to a head-end port and a rod-end port of the first hydraulic cylinder and recovers the working fluid by placing the head-end port and the rod-end port in communication according to a first recovery command, and the control device may output the first recovery command to the first recovery valve upon the regeneration.

According to this aspect, the control device outputs the first recovery command to the first recovery valve upon regeneration. Therefore, while part of the working fluid drained from the head-end port of the hydraulic cylinder is recovered to the rod-end port, the remaining working fluid can be used for regeneration. Accordingly, the flow rate of the working fluid returning to the hydraulic pump motor in the first hydraulic drive system can be reduced, meaning that the size of the hydraulic pump motor can be reduced.

In the hydraulic drive device according to the sixth aspect, in the hydraulic drive device according to the fourth or fifth aspect, the plurality of hydraulic drive systems may further include a second hydraulic drive system provided in association with a second hydraulic cylinder that is one of the plurality of hydraulic cylinders, the one or more communication valves may include a first communication valve that is connected to the first hydraulic drive system and the second hydraulic drive system and is actuated according to a first communication command, a second directional control valve that is the directional control valve in the second hydraulic drive system may switch a flow direction of the working fluid according to a second operation command, an opening degree of the second directional control valve may be controlled according to the second operation command, and the control device may output the second operation command corresponding to an operation amount of a second operation that is an operation for the second hydraulic cylinder, and when the operation amount of the first operation is greater than or equal to a first communication threshold value and the operation amount of the second operation is less than or equal to a first predetermined value upon the regeneration, open the first communication valve.

According to this aspect, when the operation amount of the first operation is greater than or equal to the first communication threshold value and the operation amount of the second operation is less than the first predetermined value upon regeneration, the first communication valve is opened. Therefore, when the flow rate of the working fluid returning from the first hydraulic cylinder is high and the operation amount of the second operation is small, the working fluid returning from the first hydraulic cylinder can be distributed to the hydraulic pump motors in the first and second hydraulic drive systems. Thus, the flow rate of the working fluid returning to the hydraulic pump motor in the first hydraulic drive system can be reduced upon regeneration. Therefore, it is possible to reduce the size of the hydraulic pump motor in the first hydraulic drive system. Furthermore, since the regeneration is performed with the plurality of hydraulic pump motors, an increased amount of the fluid energy can be regenerated as electrical energy.

In the hydraulic drive device according to the seventh aspect, in the hydraulic drive device according to the sixth aspect, the plurality of hydraulic drive systems may further include a third hydraulic drive system provided in association with a third hydraulic cylinder that is one of the plurality of hydraulic cylinders, the one or more communication valves may further include a second communication valve that is connected to the second hydraulic drive system and the third hydraulic drive system and is actuated according to a second communication command, a third directional control valve that is the directional control valve in the third hydraulic drive system may switch a flow direction of the working fluid according to a third operation command, an opening degree of the third directional control valve may be controlled according to the third operation command, and the control device may output the third operation command corresponding to an operation amount of a third operation that is an operation for the third hydraulic cylinder, and when the operation amount of the first operation is greater than or equal to a second communication threshold value greater than the first communication threshold value and the operation amount of the third operation is less than or equal to a second predetermined value upon the regeneration, open the second communication valve.

According to this aspect, when the operation amount of the first operation is greater than or equal to the second communication threshold value and the operation amount of the third operation is less than the second predetermined value upon regeneration, the second communication valve is also opened. Therefore, when the flow rate of the working fluid returning from the first hydraulic cylinder is high and the operation amounts of the second and third operations are small, the working fluid returning from the first hydraulic cylinder can be distributed to the hydraulic pump motors in the first to third hydraulic drive systems. Thus, the flow rate of the working fluid returning to the hydraulic pump motor in the first hydraulic drive system can be reduced upon regeneration. Therefore, it is possible to reduce the size of the hydraulic pump motor in the first hydraulic drive system. Furthermore, since the regeneration is performed with the plurality of hydraulic pump motors, an increased amount of the fluid energy can be regenerated as electrical energy.

In the hydraulic drive device according to the eighth aspect, in the hydraulic drive device according to the sixth or seventh aspect, the plurality of hydraulic drive systems may further include a third hydraulic drive system provided in association with a third hydraulic cylinder that is one of the plurality of hydraulic cylinders, the third hydraulic drive system may include a second recovery valve that is connected to a head-end port and a rod-end port of the third hydraulic cylinder and recovers the working fluid by placing the head-end port and the rod-end port in communication according to a second recovery command, and the control device may open the second recovery valve when the third hydraulic cylinder is extended under load.

According to this aspect, when the third hydraulic cylinder is extended under load, the second recovery valve is opened. Therefore, part of the working fluid drained from the rod-end port of the third hydraulic cylinder can be recovered to the head-end port.

In the hydraulic drive device according to the ninth aspect, in the hydraulic drive device according to the seventh or eighth aspect, the first hydraulic drive system may supply the working fluid to a boom cylinder that is the first hydraulic cylinder, the second hydraulic drive system may supply the working fluid to a bucket cylinder that is the second hydraulic cylinder, and the third hydraulic drive system may supply the working fluid to an arm cylinder that is the third hydraulic cylinder.

According to this aspect, the functions described above can be achieved in construction equipment or the like including a boom, a bucket, and an arm.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

The invention claimed is:

1. A hydraulic drive device that supplies a working fluid to a plurality of hydraulic cylinders including a first hydraulic cylinder, the hydraulic drive device comprising:

a plurality of hydraulic drive systems that are respectively associated with the plurality of hydraulic cylinders and each of which supplies the working fluid to a corresponding one of the plurality of hydraulic cylinders; and one or more communication valves that place the plurality of hydraulic drive systems in communication with each other according to a communication command that is input to the one or more communication valves, wherein:

each of the plurality of hydraulic drive systems includes: a hydraulic pump motor that discharges the working fluid and when supplied with the working fluid, rotates; an electric motor that rotatably drives the hydraulic pump motor to cause the working fluid to be discharged from the hydraulic pump motor, and generates power by being rotatably driven by the hydraulic pump motor; and a directional control valve that switches, according to an operation command, a flow direction of the working fluid flowing between the hydraulic pump motor and a corresponding one of the plurality of hydraulic cylinders;

a first hydraulic drive system that is one of the plurality of hydraulic drive systems that is associated with the first hydraulic cylinder includes a first directional control valve that is the directional control valve;

the first directional control valve causes the working fluid to flow from the first hydraulic cylinder to the hydraulic pump motor of a corresponding one of the plurality of hydraulic drive systems according to a first operation command that is input to the first directional control valve, to cause the electric motor to regenerate electrical energy; and one of the one or more communication valves distributes part of the working fluid flowing from the first hydraulic cylinder, to the hydraulic pump motor of a different one of the plurality of hydraulic drive systems that is in communication with the corresponding one of the plurality of hydraulic drive systems, to cause the electric motor that is rotatably driven by the hydraulic pump motor to regenerate electrical energy.

2. The hydraulic drive device according to claim 1, wherein:

the directional control valve is connected to the hydraulic pump motor via a pump passage in a corresponding one of the plurality of hydraulic drive systems, and is capable of blocking a path between the hydraulic pump motor and a corresponding one of the plurality of hydraulic cylinders; and each of the one or more communication valves is connected to the pump passage in a corresponding one of the plurality of hydraulic drive systems to be placed in communication.

3. The hydraulic drive device according to claim 1, wherein:

the first hydraulic drive system includes a first recovery valve that is connected to a rod-end port and a head-end port of the first hydraulic cylinder and recovers the working fluid by placing the head-end port and the rod-end port in communication according to a first recovery command.

4. The hydraulic drive device according to claim 1, further comprising:

a control device that outputs, to the first hydraulic drive system, the first operation command corresponding to an operation amount of a first operation that is an operation for the first hydraulic cylinder, wherein:

an opening degree of the first directional control valve is controlled according to the first operation command upon regeneration during which the working fluid flows from the first hydraulic cylinder to the hydraulic pump motor; and the control device outputs the communication command according to the operation amount of the first operation.

5. The hydraulic drive device according to claim 4, wherein:

the first hydraulic drive system includes a first recovery valve that is connected to a head-end port and a rod-end port of the first hydraulic cylinder and recovers the working fluid by placing the head-end port and the rod-end port in communication according to a first recovery command; and the control device outputs the first recovery command to the first recovery valve upon the regeneration.

6. The hydraulic drive device according to claim 4, wherein:

the plurality of hydraulic drive systems further include a second hydraulic drive system provided in association with a second hydraulic cylinder that is one of the plurality of hydraulic cylinders;

the one or more communication valves include a first communication valve that is connected to the first hydraulic drive system and the second hydraulic drive system and is actuated according to a first communication command;

a second directional control valve that is a directional control valve in the second hydraulic drive system switches a flow direction of the working fluid according to a second operation command, and an opening degree of the second directional control valve is controlled according to the second operation command; and the control device outputs the second operation command corresponding to an operation amount of a second operation that is an operation for the second hydraulic cylinder, and when the operation amount of the first operation is greater than or equal to a first communication threshold value and the operation amount of the second operation is less than or equal to a first predetermined value upon the regeneration, opens the first communication valve.

7. The hydraulic drive device according to claim 6, wherein:

the plurality of hydraulic drive systems further include a third hydraulic drive system provided in association with a third hydraulic cylinder that is one of the plurality of hydraulic cylinders;

the one or more communication valves further include a second communication valve that is connected to the second hydraulic drive system and the third hydraulic drive system and is actuated according to a second communication command;

a third directional control valve that is a directional control valve in the third hydraulic drive system switches a flow direction of the working fluid according to a third operation command, and an opening degree of the third directional control valve is controlled according to the third operation command; and the control device outputs the third operation command corresponding to an operation amount of a third operation that is an operation for the third hydraulic cylinder, and when the operation amount of the first operation is greater than or equal to a second communication threshold value greater than the first communication threshold value and the operation amount of the third operation is less than or equal to a second predetermined value upon the regeneration, opens the second communication valve.

8. The hydraulic drive device according to claim 7, wherein:

the first hydraulic drive system supplies the working fluid to a boom cylinder that is the first hydraulic cylinder;

the second hydraulic drive system supplies the working fluid to a bucket cylinder that is the second hydraulic cylinder; and the third hydraulic drive system supplies the working fluid to an arm cylinder that is the third hydraulic cylinder.

9. The hydraulic drive device according to claim 6, wherein:

the plurality of hydraulic drive systems further include a third hydraulic drive system provided in association with a third hydraulic cylinder that is one of the plurality of hydraulic cylinders;

the third hydraulic drive system includes a second recovery valve that is connected to a head-end port and a rod-end port of the third hydraulic cylinder and recovers the working fluid by placing the head-end port and the rod-end port in communication according to a second recovery command; and the control device opens the second recovery valve when the third hydraulic cylinder is extended under load.

* * * * *